US009290295B2

(12) United States Patent
Poggio

(10) Patent No.: US 9,290,295 B2
(45) Date of Patent: Mar. 22, 2016

(54) RESEALABLE DECANTER WITH EVACUATION SYSTEM

(71) Applicant: Alan John Poggio, Trebonne (AU)

(72) Inventor: Alan John Poggio, Trebonne (AU)

( * ) Notice: Subject to any disclaimer, the term of this patent is extended or adjusted under 35 U.S.C. 154(b) by 0 days.

(21) Appl. No.: 14/281,964

(22) Filed: May 20, 2014

(65) Prior Publication Data

US 2014/0252037 A1 Sep. 11, 2014

Related U.S. Application Data

(63) Continuation-in-part of application No. 13/636,095, filed as application No. PCT/AU2011/000304 on Mar. 18, 2011, now abandoned.

(30) Foreign Application Priority Data

Mar. 19, 2010 (AU) ..... 2010902178
Oct. 11, 2010 (AU) ..... 2010904529

(51) Int. Cl.
*B67D 1/08* (2006.01)
*B65D 8/00* (2006.01)
*B65D 81/24* (2006.01)
*B65D 85/72* (2006.01)

(52) U.S. Cl.
CPC ..... *B65D 11/04* (2013.01); *B65D 81/24* (2013.01); *B65D 85/72* (2013.01)

(58) Field of Classification Search
CPC ..... B65D 88/58; B65D 83/0005; B65D 83/0072; B65D 81/26; B65D 81/24; B65D 85/72
USPC ..... 222/386.5, 152
See application file for complete search history.

(56) References Cited

U.S. PATENT DOCUMENTS 4,298,036 A * 11/1981 Horvath ..... 141/1
4,330,066 A 5/1982 Berliner
4,361,257 A 11/1982 Stone, Jr.
4,972,969 A * 11/1990 Randklev ..... 222/1
5,165,572 A * 11/1992 Bath ..... 222/83.5

(Continued)

FOREIGN PATENT DOCUMENTS

DE 34 33 340 4/1986
EP 686597 12/1995

(Continued)

OTHER PUBLICATIONS

International Search Report for PCT/AU2011/000304.
Communication dated Nov. 10, 2014 issued by the European Patent Office for European Patent Application No. 11755568.0, pp. 1-7.

*Primary Examiner* — Patrick M Buechner
*Assistant Examiner* — Jeremy W Carroll
(74) *Attorney, Agent, or Firm* — MH2 Technology Law Group, LLP

(57) ABSTRACT

A resealable decanter associated with a gas evacuation system, the decanter having a body with an upper opening adapted to be closed with a removable sealing closure, a movable wall located within the body, the moveable wall moveable at least upwardly within the body through application of a vacuum thereto, a moveable wall guide portion associated with the moveable wall, and a valve assembly located adjacent the upper opening allowing the vacuum applied to move the moveable wall thus moving the liquid within the decanter to evacuate gas from the decanter while preventing loss of liquid from the decanter as the vacuum is applied whereby the liquid contents are removable from the decanter by pouring from the decanter.

17 Claims, 10 Drawing Sheets

(56) References Cited

U.S. PATENT DOCUMENTS

| | | | | |
|---|---|---|---|---|
| 5,373,971 | A * | 12/1994 | Laffy et al. | 222/189.09 |
| 5,988,415 | A * | 11/1999 | White | 215/266 |
| 2009/0110786 | A1* | 4/2009 | Wells | 426/115 |
| 2009/0224002 | A1* | 9/2009 | Bakhos | 222/209 |

FOREIGN PATENT DOCUMENTS

| | | |
|---|---|---|
| FR | 2 346 244 | 10/1977 |
| FR | 2528807 | 12/1983 |
| FR | 2 643 616 | 8/1990 |
| GB | 2 426 506 | 11/2006 |

* cited by examiner

RESEALABLE DECANTER WITH EVACUATION SYSTEM

CROSS-REFERENCE TO RELATED APPLICATIONS

This application is a continuation-in-part of U.S. patent application Ser. No. 13/636,095, filed Sep. 27, 2012 and entitled "RESEALABE DECANTER WITH EVACUATION SYSTEM," which is a United States national phase application under 35 U.S.C. §371 of International Patent Application No. PCT/AU2011/000304 filed on Mar. 18, 2011, and claiming the benefit of Australian Application No. 2010902178 filed on Mar. 19, 2010 and Australian Application No. 2010904529 filed on Oct. 11, 2010, all of which are herein incorporated in their entirety by reference. The International Application was published as International Publication No. WO 2011/113108 on Sep. 22, 2011.

FIELD OF THE INVENTION

The present invention relates generally to the field of apparatus to prolong the life of drinks particularly wine once opened.

BACKGROUND ART

A wine fault or defect is an unpleasant characteristic of a wine often resulting from poor winemaking practices or storage conditions, and leading to wine spoilage. Many of the compounds that cause wine faults are already naturally present in wine but at insufficient concentrations to adversely affect it. In. fact, depending on perception, these concentrations may impart positive characters to the wine. However when the concentration of these compounds greatly exceeds the sensory threshold, they replace or obscure the flavors and aromas that the wine should be expressing. Ultimately the quality of the wine is reduced, making it less appealing and sometimes undrinkable.

The oxidation of wine is perhaps the most common of wine faults, as the presence of oxygen and a catalyst are the only requirements for the process to occur. It is also known as maderized wine, from Madeira wine, which is intentionally oxidized. Oxidation can occur throughout the winemaking process, but more typically occurs after the wine has been opened and a portion remains in the bottle.

A variety of mechanisms and devices have been developed in the past in order to overcome or at least ameliorate oxidation of wine in a partially opened wine bottle. These include closures which allow the venting of gases from an open bottle which has been resealed, the application of a vacuum technology to partially withdraw any gases from an upper portion of the bottle.

Whilst all of these methods or devices have varied success, there remains the problem of minimising oxidation in previously opened partially consumed bottled wine.

Further, other beverages may also suffer from a loss of quality due to oxidation.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a resealable decanter, which may at least partially overcome at least one of the abovementioned disadvantages or provide the consumer with a useful or commercial choice.

With the foregoing in view, the present invention in one form, resides broadly in a resealable decanter associated with a gas evacuation system, the decanter having a body with an upper opening adapted to be closed with a removable sealing closure and a movable wall located within the body, the movable wall moveable at least upwardly within the body to move liquid within the decanter body toward the upper opening thus evacuating gas from the decanter body in the process.

According to an alternative embodiment, the present invention resides broadly in a resealable decanter with evacuation system, the decanter having a body with an upper opening adapted to be closed with a removable sealing closure and a lower opening adapted to be sealed by a movable wall, the evacuation system including a closure to close the opening of the decanter and an actuable expansion unit located within the decanter body in association with the movable wall to expand and move the wall as required to move the liquid within the decanter body to the upper opening thus evacuating gas from the decanter body in the process.

According to an alternative embodiment, the present invention resides broadly in a resealable decanter with evacuation system, the decanter having a body with an upper opening adapted to be closed with a removable sealing closure and a lower opening adapted to be sealed, the evacuation system including a closure to close the opening of the decanter and an actuable expansion unit located within the decanter body to expand as required to displace the liquid within the decanter body to the upper opening thus evacuating gas from the decanter body in the process.

The gas evacuation system will typically include an external vacuum pump which is engageable with the decanter to evacuate gas as required.

The decanter of the present invention will typically have an adjustable size internal storage volume. A pressure release mechanism may be provided to equalise the pressure inside and outside the decanter/storage volume prior to opening the decanter/storage volume.

The decanter will typically be generally bottle shaped. A variety of different shaped decanter bodies may be provided for different types of beverage. Typically, the decanter has a plastic body but the body may be manufactured of any other material. The decanter may be lined with a suitable material to minimise or prevent leaking and/or minimise or limit exposure to other detrimental conditions such as exposure to UV or other radiation.

Preferably, the upper opening is provided with an associated thread or similar in order to attach the sealing closure thereto. The sealing closure is typically a cap/valve assembly or a cap alone. The valve may be a ball type valve or any other suitable valve type.

The decanter will normally have a body, an upper portion and a base. However, the decanter may a single vessel with none or any number of the before mentioned components. Preferably, the decanter will have an elongate body with straight sidewalls. The decanter body will preferably be cylindrical but any cross-sectional shape may be used.

The base of the decanter may be provided as part of the evacuation system instead of being integrally formed with the decanter. Alternatively, the base may be a substantially circular member (of one or more parts) which is adapted to closed the lower end of the preferred cylindrical body.

A lower portion of the decanter body, typically the base, is preferably provided with a thread or other attachment means in order to attach the base to the decanter body. The attachment means may be internal or external or a combination.

An upper portion of the decanter body is preferably provided with a thread or other attachment means in order to attach the upper portion to the decanter body. The attachment means may be internal or external or a combination.

The upper portion of the decanter will normally include a neck portion and shoulders diverging from the neck portion to the dimension of the body. The upper portion will typically attach directly to the body and one or more seals may be provided therebetween.

The movable wall is preferably provided inside the decanter body. Preferably, the movable wall will form the base of the storage volume in the decanter body into which a liquid is placed. Preferably, the movable wall will also seal the internal volume of the decanter (in association with the sealing closure used to seal the upper opening) in order to contain a liquid placed therein.

The evacuation system may be provided such that it closes the lower opening of the decanter. The evacuation system may include an entire base or merely a portion thereof. A portion of the evacuation system engages with the attachment means on the body of the decanter. A seal will preferably be provided in order to seal a lower portion of the decanter body.

It is preferred that the evacuation system is removable from the lower portion of the decanter so that the decanter and evacuation system can be cleaned.

An expansion unit may be located within the decanter body and below the movable wall. The expansion unit is preferably actuable to expand as required to move any liquid within the decanter body towards the upper opening, thus evacuating gas from the decanter body in the process.

The expansion unit is preferably mounted in association with a closure for closing or opening of the base of the decanter body and is normally mounted relative to the closure for movement.

The expansion unit may expand in any direction, all directions, or one direction only with a portion of any expansion being upwards within the decanter body to move the movable wall. Preferably, a seal will be maintained with the inside surface of the decanter body in order to force the liquid ahead of the movable wall.

In an alternative embodiment, the evacuation system is typically provided in association with the movable wall and is actuable from outside the decanter body. In this form, the evacuation system may be separate from the decanter but adapted to be used removeably with the decanter in order to move the moveable wall within the decanter to change (either increase or decrease) the storage volume within the decanter.

The movable wall will preferably extend across the lower end of the decanter and upon actuation, move upwardly.

The movable wall may be resilient or at least an edge portion of the movable wall will be resilient in order to create and maintain a seal with the inner surface of the body of the decanter. Therefore, a seal may be provided integrally with the movable wall or separately therefrom.

In a preferred form, the moveable wall may be located within a closed decanter body. In this configuration, the decanter may be formed in a unitary manner or components of the decanter assembled with the moveable wall within. Alternatively, the decanter will be manufactured in multiple parts attachable to one another to form a storage volume with the moveable wall defining a part of the storage volume.

In the preferred embodiment, the decanter will be formed from at least three portions, namely a base wall portion, a body portion and an upper portion.

Typically, the main body portion of the decanter will be cylindrical and preferably manufactured of a substantially transparent or translucent material such as glass or plastic. A further advantage to these materials is that they can be subjected to high temperature in order to sanitise the main body portion. The main body portion will further preferably be provided with at least a portion of an attachment mechanism in order to attach the base wall portion and upper portion to the main body portion. In one preferred form, threaded portions are provided at an upper and lower end of the cylindrical main body portion with corresponding threaded portions provided on the base and upper portion.

The base wall portion will preferably be attachable to a lower end of the main body portion in order to close the lower end. Typically, sealing means will be provided in order to seal the base wall portion to the main body portion. The base wall may be vented to prevent a vacuum occurring below the moveable wall.

The upper portion will typically be attachable to an upper end of the main body portion. The upper portion may be provided with an integral shoulder expanding or widening the upper portion to correspond to the dimension of the main body portion. Again, sealing means will normally be provided in order to seal the upper portion to the main body portion.

Typically, the upper end of the upper portion will be formed with an opening and an appropriate sealing mechanism in order to seal the decanter. Preferably, a cap/valve assembly will be utilised at the upper opening.

The sealing mechanism is preferably such that a vacuum pump can be used in conjunction with the opening and/or sealing mechanism to evacuate gas from the decanter body, normally by moving the moveable wall upwardly toward the sealing mechanism to decrease the volume of storage.

The vacuum pump may withdraw or evacuate gas about the cap or closure of the decanter whilst the cap or closure is in place.

Alternatively, the vacuum pump may be used to evacuate gas from the decanter without the cap or closure. Operation of the vacuum pump preferably draws the movable wall towards the neck until the liquid is approximately at the level of the opening in the neck at which time the cap or closure can be placed onto the neck sealing the decanter.

Preferably, the movable wall and/or interior surface of the main body portion is provided with an alignment means which maintains the movable wall in sealing engagement with the inner surface of the main body portion. Preferably, the movable wall will move upwardly and downwardly without tilting as this may cause a loss of seal between the movable wall and the main body portion which may allow the liquid to seep or flow, between the movable wall and the main body portion. It is preferred that the liquid at all times remain above the movable wall and that the movable wall remains sealed to the interior surface of the main body portion. Therefore, movement of the movable wall will in turn move the level of the liquid.

The moveable wall may be provided with an upwardly extending portion in order to minimise the head space in the upper portion of the decanter particularly when the moveable wall is located adjacent or above the top of the body. Due to the shape of the upper portion, without providing an upwardly extending portion to minimise the head space in the decanter, the decanter would be less useful as there would be a volume which cannot be decreased once the moveable wall reaches a converging portion of the decanter.

The upper portion of the decanter will normally be provided with depressed sections in order to minimise the head space in the upper portion.

A valve assembly is preferably provided in association with the closure of the decanter. Preferably the cap and valve assembly are provided as separate but engageable components. The valve assembly will preferably limit or prevent liquid escaping or being lost from the decanter into or through the preferred vacuum pump but will allow gas to be drawn from the decanter by the preferred vacuum pump. The valve assembly may be permanently positioned in the upper portion of the decanter or alternatively, may be removeably engageable with the upper portion.

The valve assembly will preferably be provided as a sleeve portion adapted to be received at least partially within the neck of the upper portion of the decanter. The sleeve portion will normally be securable within the neck portion and typically, a thread arrangement is provided on an internal surface of the neck portion and an external portion of the sleeve. A valve will normally be provided at a lower part of the sleeve portion, normally to be located centrally across the opening of the decanter. The valve will preferably be a non-return type valve and a captured ball valve is particularly preferred. According to this particularly preferred embodiment, a ball valve member is located in a valve surround and at least a pair of openings are provided in the surround, one on the decanter side of the surround and one associated with the opening of the decanter. More openings may be provided such as for example, through one or more of the sidewalls of the surround. The openings may be any shape.

The ball valve member will preferably move within the surround in order to allow gas to be evacuated from the decanter upon application of a vacuum inducing pump but will preferably prevent loss of liquid from the decanter. According to a preferred embodiment, the ball valve member will typically move to allow gas to exit the decanter through the openings in the surround, flow around the ball valve member and exit through the upper opening. As the movable wall moves upwardly and the level of liquid in the decanter rises toward the valve assembly, and the liquid level will typically lift the ball valve member to close the opening in the upper portion of the surround, thereby preventing liquid being drawn out of the decanter by the vacuum pump. Therefore, the ball valve member will preferably be buoyant relative to the liquid but be weighted to limit or prevent the ball valve member the sealing the upper opening in the surround under the action of the vacuum pump.

The ball valve member may have a guide portion associated therewith to limit or control movement of the ball valve member. According to one preferred form, a guide portion may be provided as an extension from the ball valve member adapted to engage part of the surround in order to limit the movement of the ball valve to a reciprocal movement towards and away from the decanter opening. A limit means may be provided with the guide means to limit the degree of movement allowed. In this embodiment, an enlarged head may be provided to suspend the ball valve member relative to the opening but allow movement towards and away from the opening until moved to the closed condition by the liquid level.

Normally the ball valve member can move within the surround but movement is limited.

A keylock mechanism is preferably provided between the cap and the valve sleeve. Preferably, a pair of corresponding portions are provided, one on the cap and one on the preferred valve sleeve to allow the cap and a valve sleeve to engage one another. This will typically allow rotation of the cap and due. to the engagement between the cap and the valve sleeve, the valve sleeve can be rotated. This configuration is particularly useful to remove the valve sleeve which is preferably engaged with the upper portion of the decanter by a threaded portion.

Preferably, the corresponding portions will take the form of a key and slot. According to the most preferred embodiment, at least one, and normally a pair of opposed slots are provided on the cap, and at least one and normally a pair of opposed corresponding key protrusions are provided on an internal portion of the valve sleeve such that when the cap is inserted into the valve sleeve, the cap may be rotated until the keys are aligned with the slots whereupon the cap can be pushed further downwardly into the valve sleeve. In this position, rotation of the cap will typically rotate the valve sleeve. Pulling the cap away from the valve sleeve will typically disengage the corresponding portions allowing removal of the cap without disengagement of the valve sleeve.

Preferably, the expansion unit may be a bellows or concertina type expansion unit.

Alternative mechanisms for moving the movable wall may include pneumatic, manual, sliding, biased or the like. The two main types will be an air expansion bellows or a manual, sliding expansion mechanism. According to the bellows configuration, air or another gas may be forced into the expansion unit to expand the expansion unit, to move the movable wall upwards.

In the alternative manual, sliding mechanism, a flexible but fixed length rod may be provided extending substantially parallel to an outer portion of the decanter before an arcuate portion which extends under the decanter bottom and upwardly towards the movable wall. Depression of the rod downwardly parallel to the decanter will typically force the movable wall upwards. Guides will typically be provided to guide any movement, including roller guides in order to guide the arcuate movement.

In an alternative configuration wherein the fluid is displaced within the decanter, any method of displacement may be used. Typically however, a bladder or similar will be provided within the decanter body and changes in volume of the bladder will displace the fluid in the decanter body. The bladder may expand in any direction, all directions, or one direction only. The bladder may therefore be a concertina type bladder which expands upwardly or a flexible bladder that expands in three dimensions within the decanter body to displace the fluid within the decanter body upwards towards the upper opening of the decanter.

Preferably, a sleeve is provided about the decanter in order to cover any moving parts. This sleeve will have a base which also protects the lower portion of the mechanism. Preferably an aesthetically pleasing material is used for the sleeve such as stainless steel or similar. This sleeve may be spaced from the body of the decanter in order to allow material to be located within the space to adjust .the temperature of the beverage or alternatively, this sleeve may closely receive the body of the decanter.

Typically, the sleeve will be opaque and obscure a lower portion of the decanter leaving the upper portion of the decanter visible. Alternatively, all or part of the decanter may be transparent, this will allow a user to observe the rising beverage level as the movable wall extends upwardly until the valve at the upper opening of the decanter is activated. In the absence of a valve the user will need to observe the rising beverage level in order that the beverage not overflow.

Weighting may be provided at a lower level on the decanter in order to provide stability to the decanter, particularly when the liquid contained therein is towards the upper end of the decanter. The weighting may be provided in association with the base.

In use, a beverage which is the subject to deterioration by oxidation may be decanted into the decanter body whereupon the movable wall can be actuated to move the upper level of the liquid to be closely spaced from the upper opening of the decanter, preferably by means of a vacuum pump associated with the decanter opening to evacuate the gas from the decanter, in order to minimise any gas remaining in the decanter body after which the sealing closure can be placed over the upper opening. In this way, a minimum amount of oxygen or other gas is maintained above the liquid which in turn will minimise the degree of oxidation of the liquid, thus maintaining quality of the liquid.

According to an alternative embodiment, the present invention resides broadly in a resealable decanter associated with a gas evacuation system, the decanter having a body with an upper opening adapted to be closed with a removable sealing closure, a movable wall located within the body, the moveable wall moveable at least upwardly within the body through application of a vacuum thereto, a moveable wall guide portion associated with the moveable wall, and a valve assembly located adjacent the upper opening allowing the vacuum applied to move the moveable wall thus moving the liquid within the decanter to evacuate gas from the decanter whilst preventing loss of liquid from the decanter as the vacuum is applied whereby the liquid contents are removable from the decanter by pouring from the decanter.

The movable wall is preferably provided inside the decanter body. Preferably, the movable wall will form the base of the storage volume in the decanter body into which a liquid is placed. Preferably, the movable wall will also seal the internal volume of the decanter (in association with the previously-described sealing closure used to seal the upper opening) in order to contain a liquid placed therein.

The movable wall will preferably extend across the lower end of the decanter and upon actuation, move upwardly.

The movable wall may be resilient or at least an edge portion of the movable wall will be resilient in order to create and maintain a seal with the inner surface of the body of the decanter. Therefore, a seal may be provided integrally with the movable wall or separately therefrom.

The moveable wall guide portion may be of any suitable form. Preferably, the moveable wall guide portion is located at least partially within the body. It is envisaged that the moveable wall guide portion may be adapted to ensure smooth and uniform movement of the moveable wall during the application of the vacuum to the decanter.

The moveable wall guide portion may move with the moveable wall, or the moveable wall guide portion may remain stationary and the moveable wall may move relative to the moveable wall guide portion.

In embodiments of the invention in which the moveable wall guide portion remains stationary relative to the moveable wall, the moveable wall guide portion may be attached to any suitable part of the decanter. For instance, the moveable wall guide portion may be attached to an inner surface of the body. More preferably, however, the moveable wall guide portion may be attached to a base portion (such as a base wall portion) of the decanter.

The moveable wall guide portion may be of any suitable size, shape or configuration. However, in a preferred embodiment of the invention, the moveable wall guide portion comprises one or more elongate members. The one or more elongate members may be located at any suitable location within the body and at any suitable orientation to the body. It is envisaged, however, that at least one of the one or more elongate members is oriented to extend at least part way between the base of the decanter and the upper opening. Any suitable elongate member may be provided, such as one or more tubes, rods or the like. The elongate member may have any suitable cross-sectional shape, and it will be understood that the exact configuration of the elongate member (cross-sectional shape, diameter etc.) is not critical to the invention. However, it will also be understood that it would be advantageous to minimise the dimensions of the elongate member as much as possible to reduce the volume of the decanter occupied by the moveable wall guide portion.

In some embodiments of the invention, a lower portion of the moveable wall guide portion may be connected to a base wall portion of the decanter, while an upper portion of the moveable wall guide portion may be connected to an upper portion of the decanter. More preferably, however, the moveable wall guide portion is connected to the decanter only at the base wall portion thereof. In this embodiment, it is envisaged that the moveable wall guide portion may extend upwardly from the base wall portion and that the upper portion of the moveable wall guide portion may be unconnected to any part of the decanter.

Preferably, the moveable wall guide portion extends upwardly into the body of the decanter so that the upper end of the moveable wall guide portion is located at a point above the upper limit of movement of the moveable wall. In this way, it is not possible for the moveable wall to become disconnected from the moveable wall guide portion.

In a preferred embodiment of the invention, the moveable wall guide portion may extend upwardly from the base wall portion of the decanter in a substantially vertical orientation. The base wall portion may be formed integrally with the body or may be formed separately therefrom and adapted for fixed or removable attachment thereto. The base wall portion may be provided with one or more receiving portions in which a lower end of the moveable wall guide portion may be received and retained. The lower end of the moveable wall guide portion may be retained in a frictional engagement with the receiving portion, or may be retained in place using one or more fasteners, clips or the like, or a combination thereof. In some embodiments of the invention, the receiving portion and the lower end of the moveable wall guide portion may be provided with complimentary screw threads so that the receiving portion and the lower end of the moveable wall guide portion may be retained in screw-threaded attachment to one another.

In a particular embodiment of the invention, the moveable wall guide portion comprises a single elongate member attached at a substantially central point of the base wall portion and extending substantially vertically upwardly into the body of the decanter. Thus, the receiving portion may be located in a substantially central portion of the base wall portion.

In some embodiments, the moveable wall guide portion may be at least partially surrounded by the moveable wall. In these embodiments, it is envisaged that the moveable wall guide portion may pass through at least a portion of the moveable wall. Thus, the moveable wall may be provided with one or more apertures therein through which the moveable wall guide portion may pass.

In embodiments of the invention in which the moveable wall is provided with one or more apertures therein through which the moveable wall guide portion may pass, it is preferred that at least one of the one or more apertures is provided in a substantially central portion of the moveable wall. In this way, the aperture in the moveable wall may be substantially aligned with the receiving portion in the base wall portion so that the moveable wall guide portion may extend substantially vertically through the aperture in the moveable wall and be received in the receiving portion.

Preferably, when the moveable wall guide portion passes through the moveable wall, a seal may be formed between the moveable wall guide portion and the moveable wall, so that liquid in the decanter is prevented from passing through the aperture in the moveable wall. However, in some embodiments of the invention, the moveable wall may be provided with a seal portion adapted to abut the moveable wall guide portion and thereby form a seal against the moveable wall guide portion so as to prevent liquid from passing through the aperture in the moveable wall. Preferably, the seal portion abuts the moveable wall guide portion about the entire outer surface of the moveable wall guide portion along at least a portion of the height of the moveable wall guide portion.

The seal portion may be of any suitable form. For instance, the seal portion may be fabricated from a resilient material (such as rubber or a polymeric material) that forms a frictional seal against the moveable wall guide portion. The seal portion may be fabricated from the same material as the moveable wall or may be fabricated from a different material to the moveable wall. The seal portion may be formed integrally with the moveable wall, or may be formed separately from the moveable wall and adapted for fixed or removable attachment thereto using any suitable technique.

In some embodiments of the invention, the seal portion may be attached to the moveable wall using one or more mechanical fasteners (such as bolts, nails, screws, rivets or the like, or a combination thereof). Alternatively, the seal portion may be attached to the moveable wall using adhesives.

The seal portion may be formed in a single piece, or maybe formed as two or more pieces that are adapted for connection to one another.

In some embodiments of the invention, the seal portion may comprise a sealing member such as one or more o-rings, gaskets or the like, or a combination thereof. Alternatively, the seal portion may comprise a member including one or more o-rings, gaskets or the like, or a combination thereof. For instance, the seal portion may include a block with which one or more sealing members are associated.

In a preferred embodiment of the invention, the seal portion may be provided with one or more apertures therethrough. Preferably, at least one of the one or more apertures may be located substantially centrally in the seal portion such that, in use, the aperture in the moveable wall, the aperture in the seal portion and the receiving portion in the base wall portion are in substantial alignment with one another so that the moveable wall guide portion may be positioned substantially vertically within the body.

As previously stated, upon application of a vacuum to the decanter, the moveable wall will move upwardly. Thus, it is envisaged that the moveable wall will also move upwardly relative to the moveable wall guide portion on application of a vacuum to the decanter. As the moveable wall moves upwardly, it is envisaged that the seal portion will also slide upwardly relative to the moveable wall guide portion due to its association with the moveable wall. Typically, however, the abutment between the seal portion and the moveable wall guide portion will maintain a constant seal between the seal portion and the moveable wall guide portion, thereby preventing liquid from passing between the seal portion and the moveable wall guide portion towards the base wall portion of the decanter.

The moveable wall may be provided with an upwardly extending portion in order to minimise the head space in the upper portion of the decanter particularly when the moveable wall is located adjacent or above the top of the body. The upwardly extending portion of the moveable wall may also suitably include a gripping portion. It is envisaged that the gripping portion may be used to remove the moveable wall from the decanter, such as for repair, replacement or cleaning. Removal of the moveable wall may be achieved by gripping the gripping portion with a tool or the like. Alternatively, the moveable wall may be removed manually, for instance by a user gripping the gripping portion with their fingers and applying a force to the gripping portion so as to remove the moveable wall from the decanter.

It is envisaged that the presence of the moveable wall guide portion in the decanter will ensure that the upward movement of the moveable wall will be smooth and uniform. In addition, it is envisaged that the presence of the moveable wall guide portion will assist in maintaining a seal between the moveable wall and the body of the decanter. It is envisaged that the seal will be maintained as the presence of the moveable wall guide portion will substantially prevent the moveable wall from "tilting" as it moves (i.e. one side of the moveable wall moving upwardly at a more rapid rate than the other side), thereby ensuring that the seal between peripheral edge of the moveable wall and the body is not broken.

BRIEF DESCRIPTION OF THE DRAWINGS

Various embodiments of the invention will be described with reference to the following drawings, in which.

DETAILED DESCRIPTION OF THE PREFERRED EMBODIMENT

Figure 1:
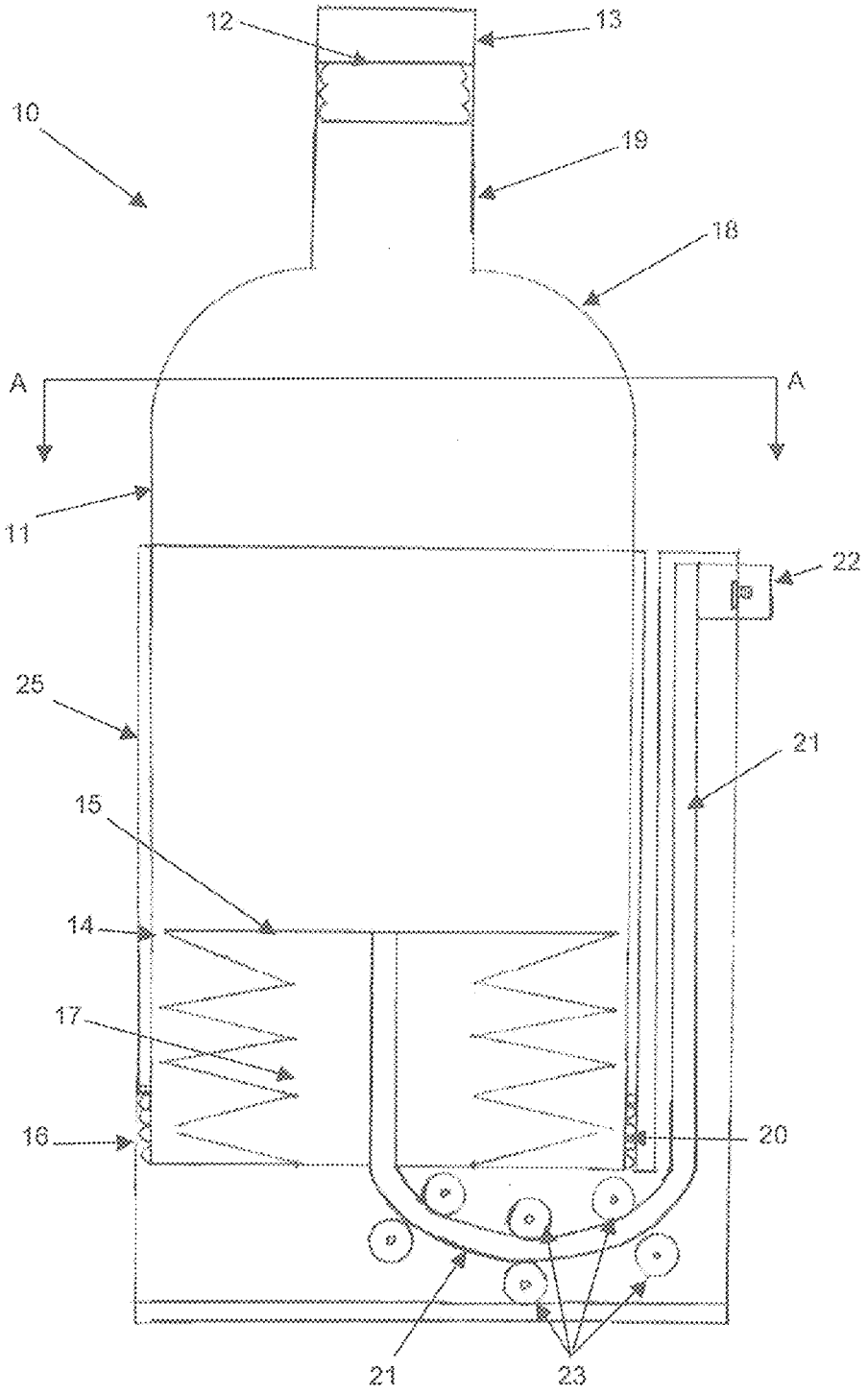
FIG. 1 is a schematic sectional side view of a resealable decanter with evacuation system according to a preferred embodiment of the present invention.
Figure 2:
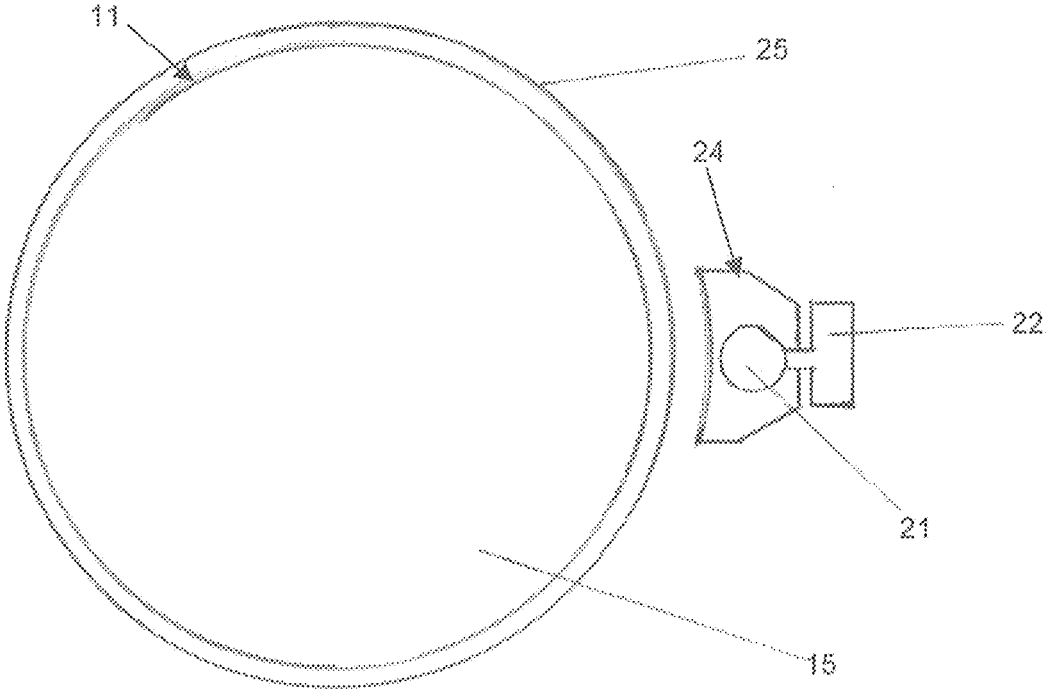
FIG. 2 is a sectional view from above of the resealable decanter illustrated in FIG. 1 along line A-A.

According to a preferred embodiment of the present invention a resealable decanter with evacuation system is provided.

The resealable decanter 10 illustrated in the Figures has a body 11 with an upper opening 12 adapted to be closed with a removable sealing cap 13 and a lower opening 14 adapted to be sealed by a movable wall 15. The evacuation system illustrated includes a closure 16 to close the opening of the decanter 10 and an actuable expansion unit 17 located within the decanter body 11 in association with the movable wall 15 to expand and move the wall 15 as required to move the liquid within the decanter body 11 to the upper opening 12 thus evacuating gas from the decanter body 11 in the process.

Therefore the decanter has an adjustable size internal volume for holding a liquid.

The decanter body 11 is generally bottle shaped and will normally be glass.

Preferably, the upper opening 12 is provided with an associated thread or similar in order to attach the sealing cap 13 thereto. The sealing cap 13 illustrated is a screw cap. The decanter 10 will normally have a body 11, a shoulder 18, a neck 19 and a base provided as part of the evacuation system instead of being integrally formed with the decanter. The illustrated decanter has a long body 11 with straight sidewalls and a short neck 19.

A lower portion of the decanter body 11 is provided with an external thread 20 in order to attach the evacuation system to the decanter 10.

The movable wall 15 is provided inside the decanter body H and according to the illustrated embodiment forms the base of the volume in the decanter body 11.

The evacuation system is provided in association with the movable wall 15 and actuable from outside the decanter body 11.

The evacuation system illustrated closes the lower opening of the decanter body 11. A portion of the evacuation system engages with the external thread 20 on the body 11 of the decanter. A seal is provided in order to seal the evacuation system to a lower portion of the decanter body 11.

The movable wall 15 seals the internal volume of the decanter body 11 in order to contain a liquid placed therein.

An expansion unit 17 is located within the decanter body 11 and below the movable wall 15. The expansion unit 17 is actuable to expand as required to move any liquid within the decanter body towards the upper opening 12, thus evacuating gas from the decanter body 11 in the process.

The expansion unit 17 is mounted relative to the closure 16 for movement.

The movable wall 15 extends across the lower end of the decanter body 11 and upon actuation, moved upwardly. A seal is maintained with the inside surface of the decanter body 11 in order to force the liquid ahead of the movable wall 15.

The expansion unit 17 illustrated is a bellows or concertina type expansion unit.

The expansion mechanism includes a flexible but fixed length rod 21 provided extending substantially parallel to an outer portion of the decanter before an arcuate portion which extends under the decanter bottom and upwardly towards the movable wall 15. Depression of the rod 21 downwardly parallel to the decanter using a plunger 22 forces the movable wall 15 upwards. An elongate guide 24 is provided to guide the depression movement of the plunger 22, including roller guides 23 in order to guide the arcuate movement.

A sleeve 25 is provided about the decanter body 11 in order to cover any moving parts. This sleeve 25 has a base which also protects the lower portion of the mechanism. Preferably an aesthetically pleasing material is used for the sleeve such as stainless steel or similar.

The sleeve 25 is opaque and obscures a lower portion of the decanter body 11 leaving the upper portion of the decanter body visible. If the decanter is transparent, this will allow a user to observe the rising beverage level as the movable wall extends upwardly, in order that the beverage not overflow.

In use, a beverage which is the subject to deterioration by oxidation is decanted into the decanter body 11 whereupon the movable wall 15 can be actuated to move the upper level of the liquid to be closely spaced from the upper opening 12 of the decanter in order to minimise any gas remaining in the decanter body 11 after which the sealing cap 13 can be placed over the upper opening 12. In this way, a minimum amount of oxygen or other gas is maintained above the liquid which in turn will minimise the degree of oxidation of the liquid which can occur thus maintaining quality of the liquid.

Figure 3:
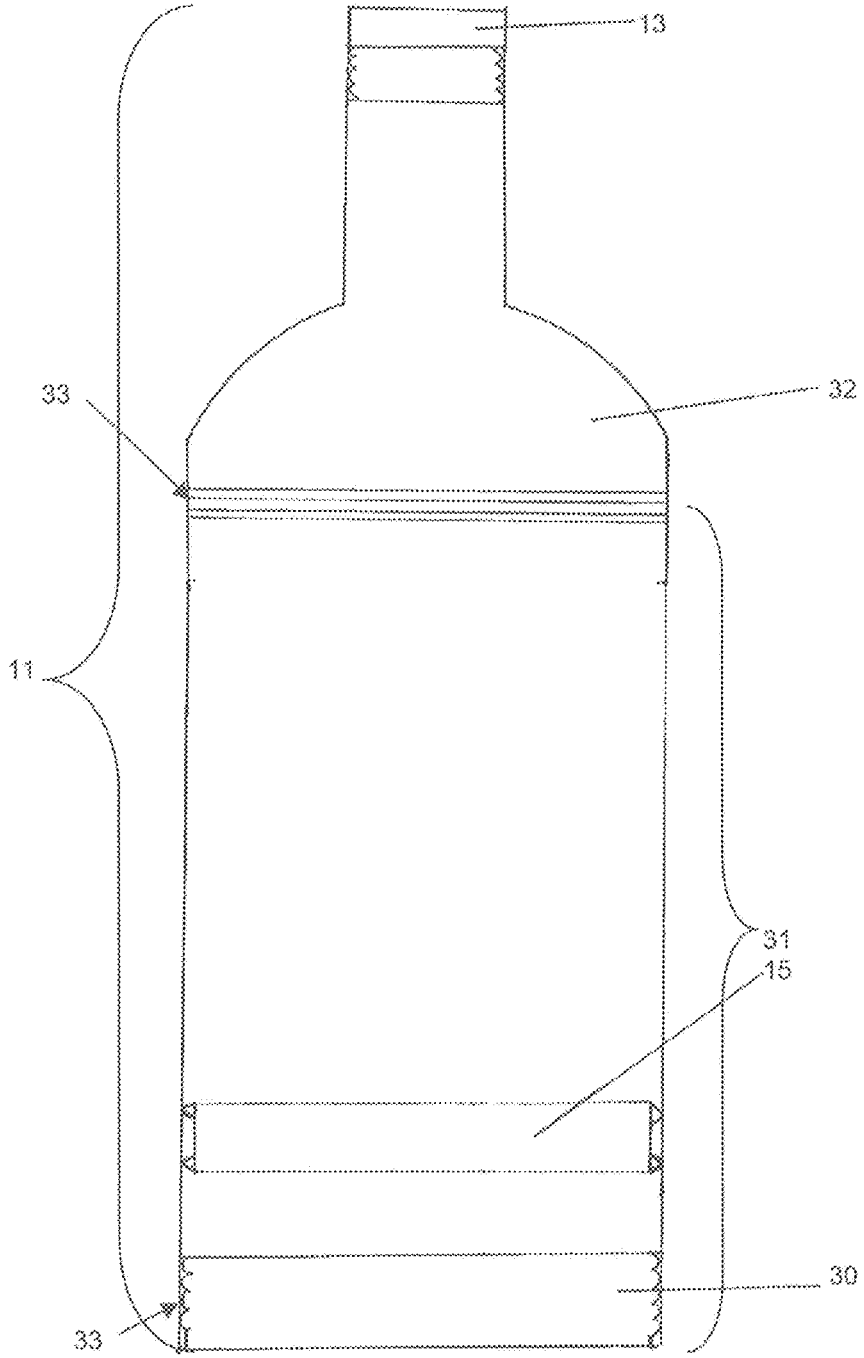
FIG. 3 is a sectional side view of an alternative preferred embodiment of the present invention.

According to an alternative preferred embodiment illustrated in FIG. 3, the resealable decanter 10 has a body 11 with an upper opening adapted to be closed with a removable sealing cap 13 and a movable wall 15 located within the body 11. The movable wall 15 is moveable upwardly within the body 11 to move liquid (not shown) within the decanter body to the upper opening thus evacuating gas from the decanter body 11 in the process.

In the preferred embodiment illustrated in FIG. 3, the decanter body 11 is formed from three portions, namely a base wall portion 30, a main body portion 31 and a neck portion 32.

The main body portion is cylindrical and manufactured of a substantially transparent or translucent material such as glass or plastic.

The main body portion 31 is provided with threaded portions 33 at an upper and lower end of the cylindrical main body portion 31 with corresponding threaded portions provided on the base wall portion 30 and neck portion 32. The base wall portion 30 is attachable to a lower end of the main body portion 31 in order to close the lower end. Sealing means is provided in order to seal the base wall portion 30 to the main body portion 31.

The neck portion 32 is attachable to an upper end of the main body portion 31. The neck portion 32 is provided with an integral shoulder 18 expanding or widening the neck portion 32 to correspond to the dimension of the main body portion 31. Again, sealing means is provided in order to seal the neck portion 32 to the main body portion 31.

Typically, the upper end of the neck portion will be formed with an opening and an appropriate sealing cap 13 in order to seal the decanter.

Figure 4:
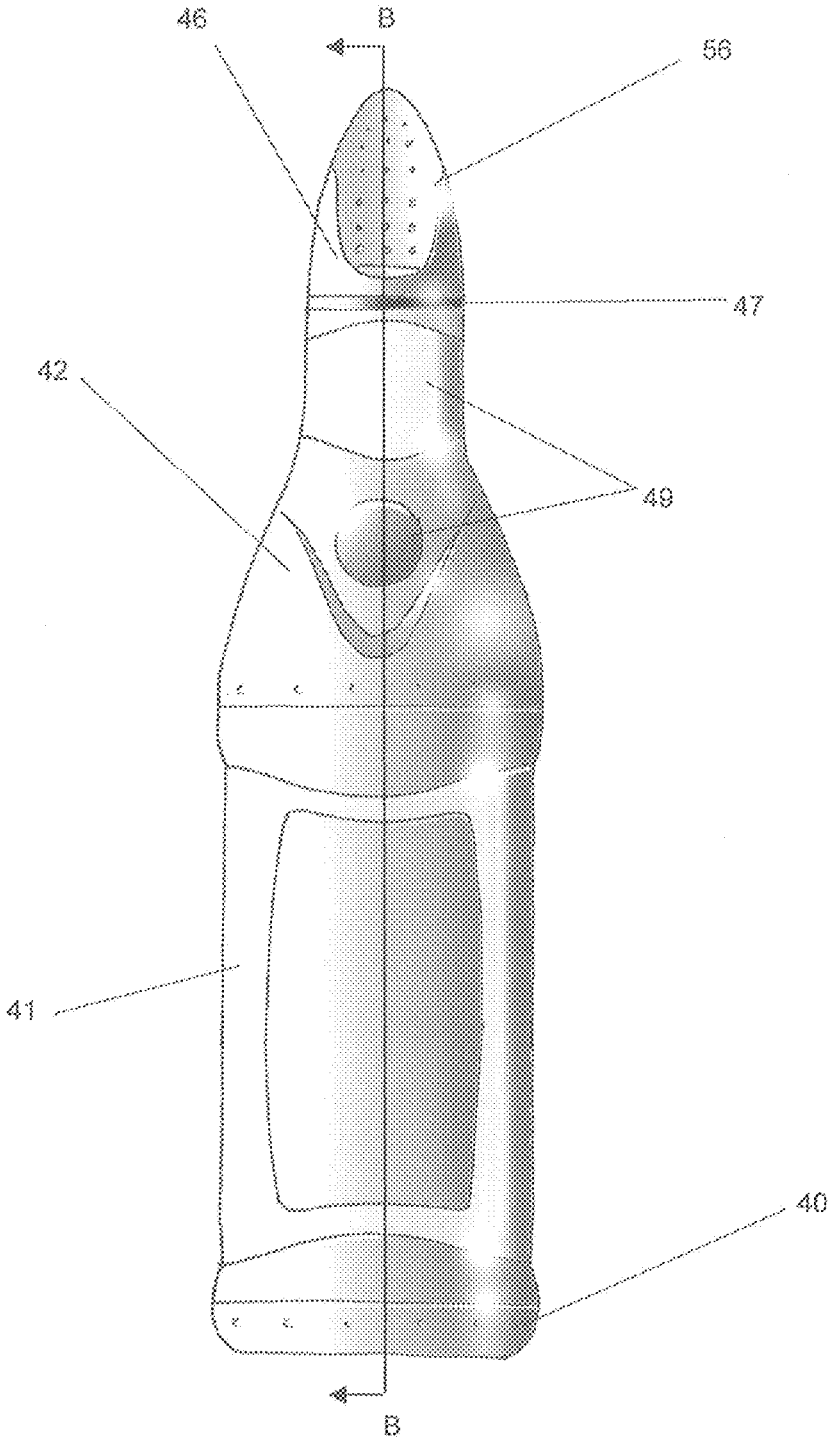
FIG. 4 is an elevation view of a further alternative embodiment of the present invention.
Figure 5:
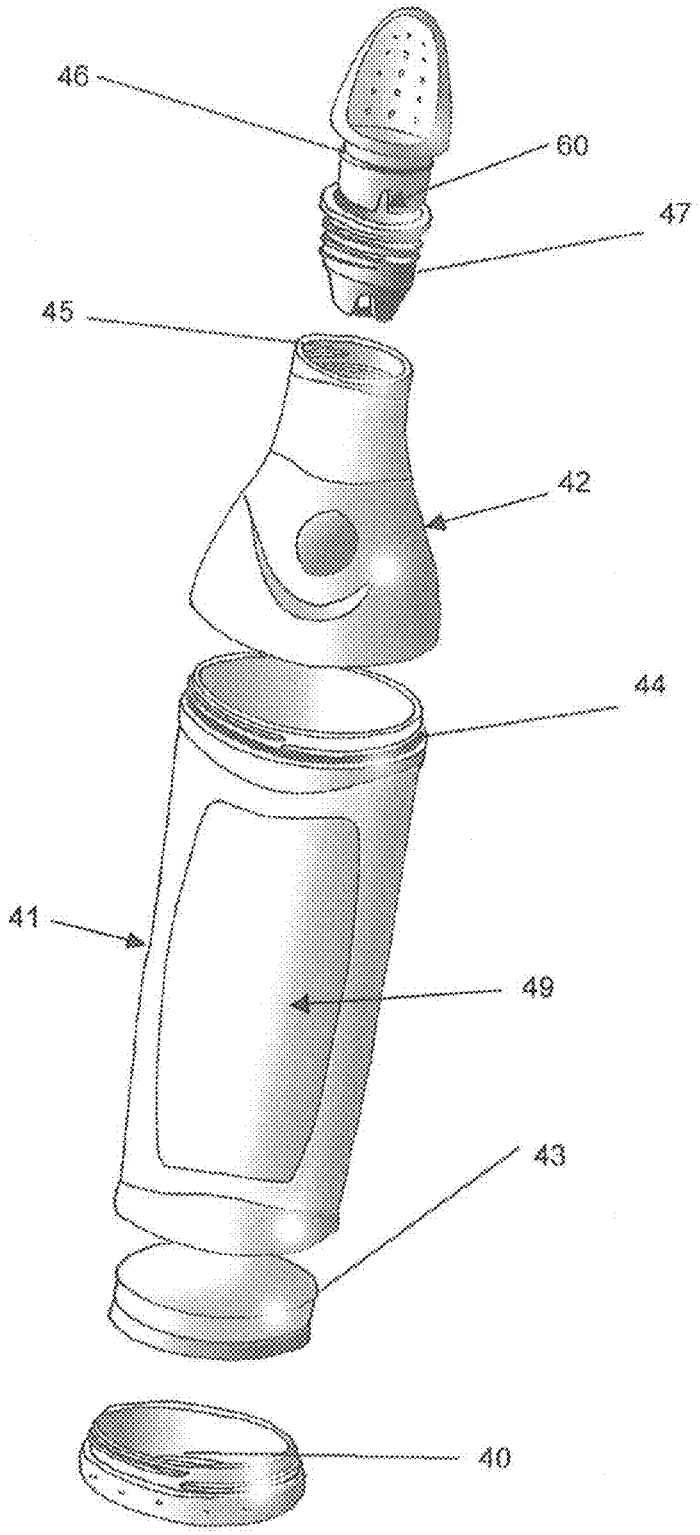
FIG. 5 is an exploded view of the embodiment illustrated in FIG. 4.
Figure 6:
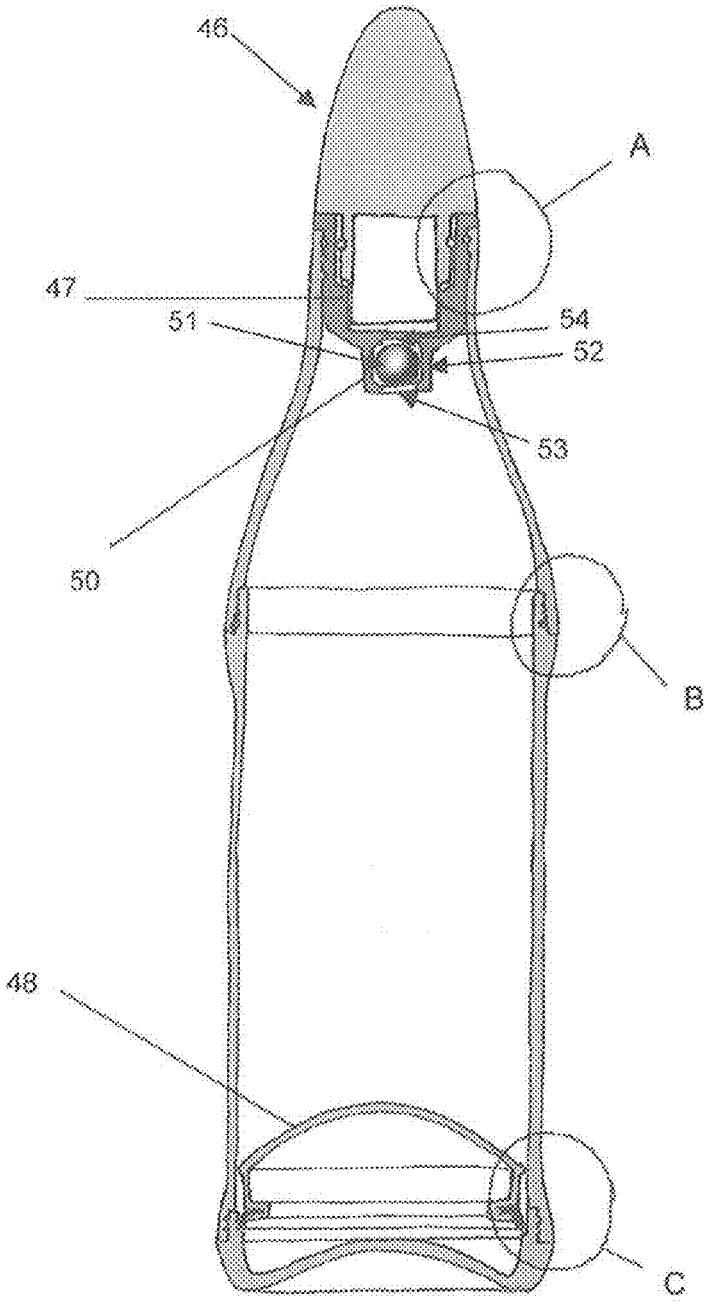
FIG. 6 is a sectional view of the embodiment illustrated in FIG. 4 along line B-B.

According to the alternative embodiment illustrated in FIGS. 4 to 6, the decanter is formed from at least three portions, namely a base 40, a body portion 41 and an upper portion 42.

The main body portion of the decanter is cylindrical and is provided with a pair of threaded portions in order to attach the base and upper portion to the main body portion. In one preferred form, threaded portions are provided at an upper and lower end of the cylindrical main body portion with corresponding threaded portions provided on the base and neck portion.

The base 40 is attachable to a lower end of the main body portion in order to close the lower end. Advertising or branding areas 49 are provided on the upper portion 42.

A seal 44 is provided in order to seal the base 40 and the upper portion 42 to the main body portion 41.

The base 40 is vented to prevent a vacuum occurring below the moveable wall 43.

The upper portion 42 is attachable to an upper end of the main body portion 41. The upper portion 42 is provided with an integral shoulder expanding or widening the upper portion 42 to correspond to the dimension of the main body portion 41.

Typically, the upper end of the upper portion will be formed with an opening 45 and a cap 46 and valve assembly 47 is provided at the upper opening.

The moveable wall 43 as illustrated is provided with an upwardly extending portion 48 in order to minimise the head space in the upper portion 42 of the decanter particularly when the moveable wall 43 is located adjacent or above the top of the body 41. Due to the shape of the upper portion 42, without providing an upwardly extending portion to minimise the head space in the decanter, the decanter would be less useful as there would be a volume which cannot be decreased once the moveable wall reaches a converging portion of the decanter.

The upper portion 42 of the decanter is provided with depressed sections in order to minimise the head space in the upper portion 42 as well as grip areas 56 to allow a user greater leverage to remove the cap.

A valve assembly 47 is provided in association with the cap 46 of the decanter. Preferably the cap 46 and valve assembly 47 are provided as separate but engageable components which together form sealing closure 90.

The valve assembly 47 illustrated is a sleeve portion 92 adapted to be received at least partially within the neck of the upper portion 42 of the decanter as illustrated in FIG. 6. The sleeve portion 92 is securable within the neck portion and a thread arrangement is provided for this purpose. The cap 46 is typically pushed into the valve assembly 47 and retained there in an interference fit. A seal 55 is provided to enhance the fit.

A valve 50 is provided at a lower part of the sleeve portion 92, normally to be located centrally across the opening of the decanter. The valve 50 illustrated is a captured ball valve. According to this particularly preferred embodiment, a ball valve member 51 is located in a valve surround 52 and a pair of openings are provided in the surround, one on the decanter side of the surround and one associated with the opening of the decanter. The opening 54 in the surround 52 associated with the opening of the decanter is positioned such that the ball valve member can seal the opening when the liquid in the decanter raises the ball valve member as the liquid level moves towards the decanter opening.

The ball valve member 51 can move within the surround 52 in order to allow gas to be evacuated from the decanter upon application of a vacuum inducing pump (not shown) but will preferably prevent loss of liquid from the decanter. According to the embodiment illustrated in FIG. 6, the ball valve member 51 moves to allow gas to exit the decanter through the decanter side opening 53, flow around the ball valve member 51 and exit through the upper opening 54. As the movable wall 43 moves upwardly and the level of liquid in the decanter rises toward the valve assembly, and the liquid level lifts the ball valve member 51 to close the upper opening in the surround 52, thereby preventing liquid being drawn out of the decanter by the vacuum pump. Therefore, the ball valve member is preferably buoyant relative to the liquid but be weighted to limit or prevent the ball valve member the sealing the upper opening in the surround under the action of the vacuum pump.

Normally the ball valve member 51 can move within the surround 52 but movement is limited.

The gas evacuation system will typically include an external vacuum pump (not illustrated) which is engageable with the decanter to evacuate gas as required.

The vacuum pump is used to evacuate gas from the decanter before the cap 13 has been used to seal the opening. Operation of the vacuum pump preferably draws the movable wall 15 towards the upper opening until the liquid is approximately at the level of the opening in the neck at which time the cap 13 can be placed onto the neck sealing the decanter.

According to the preferred embodiment, a vacuum pump is used to move the moveable wall 43 upward until the liquid level actuates the valve assembly to prevent fluid escaping from the decanter.

A keylock mechanism is provided between the cap 46 and the valve sleeve 47. Corresponding portions are provided, one on the cap and one on the preferred valve sleeve to allow the cap and a valve sleeve to engage one another to form sealing closure 90.

Figure 6A:
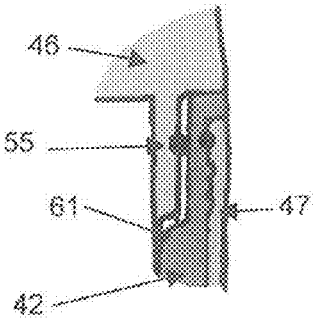
FIG. 6A is a detailed view of the area designation "A" in FIG. 6.
Figure 6B:
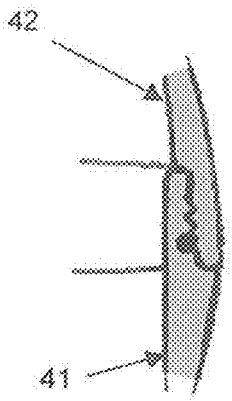
FIG. 6B is a detailed view of the area designation "B" in FIG. 6.
Figure 6C:
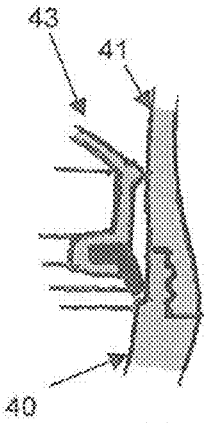
FIG. 6C is a detailed view of the area designation "C" in FIG. 6.

According to the embodiment illustrated in FIGS. 5 and 6A in particular, a pair of opposed slots 60 are provided on the cap 46, and a pair of opposed corresponding keys 61 are provided on an internal portion of the valve sleeve 47 such that when the cap 46 is inserted into the valve sleeve 47, the cap 46 can be rotated until the keys 61 are aligned with the slots 60 whereupon the cap 46 can be pushed further downwardly into the valve sleeve 47. In this position, rotation of the cap 46 rotates the valve sleeve 47. Pulling the cap 46 away from the valve sleeve 47 disengages the corresponding portions allowing removal of the cap 46 without disengagement of the valve sleeve 47.

This configuration is particularly useful to remove the valve sleeve 47 which is preferably engaged with the upper portion 42 of the decanter by a threaded portion.

Figure 7:
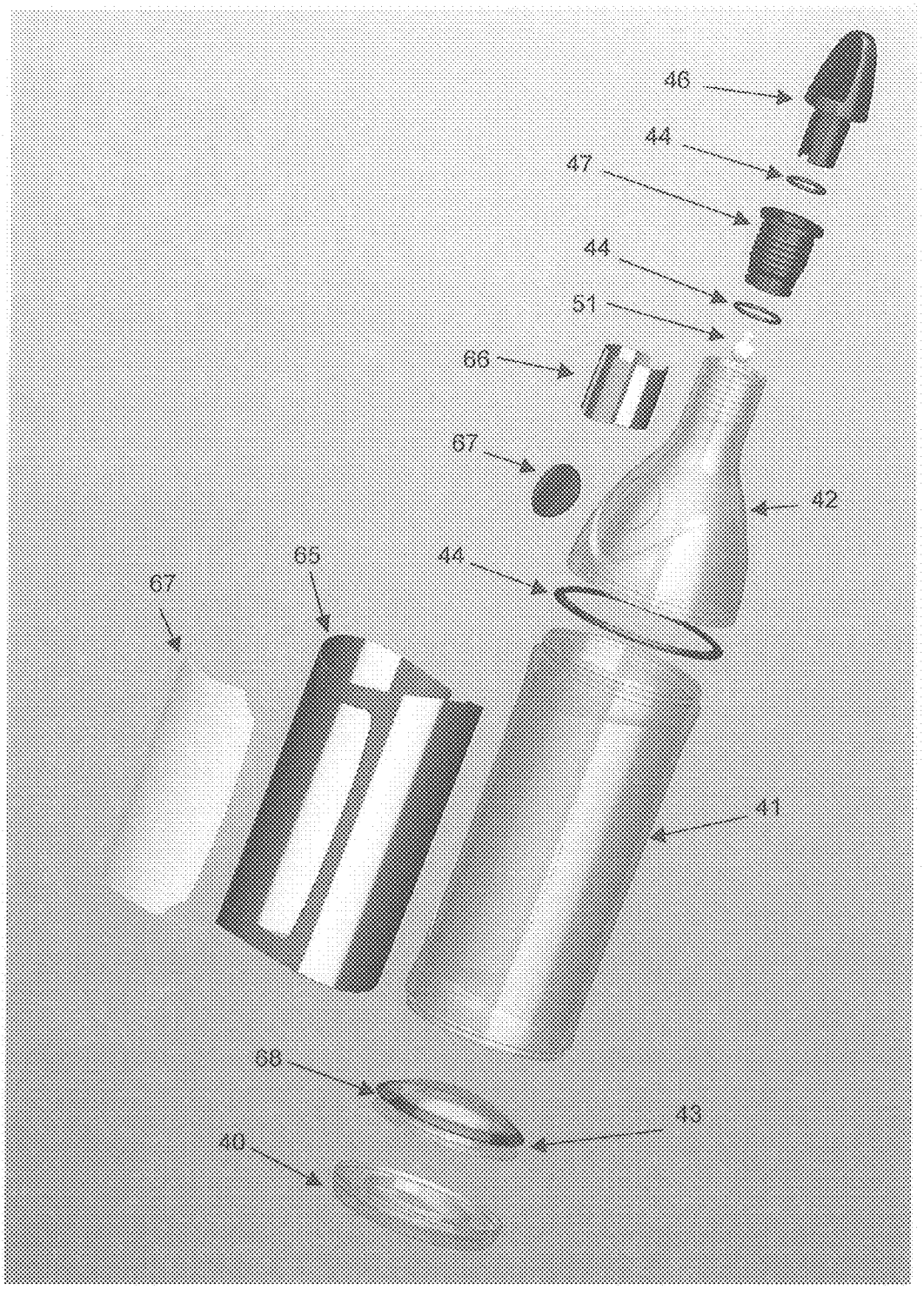
FIG. 7 is an exploded view of a further preferred embodiment of the decanter of the present invention.

FIG. 7 is an exploded view of a further preferred embodiment of the decanter of the present invention. The decanter illustrated in FIG. 7 has all of the components of the embodiment illustrated in FIG. 5, namely:

- Cap 46
- Valve sleeve 47
- Upper portion 42
- Decanter opening 45
- Seals 44
- Body 41
- Moveable wall 43 with an upward bulge 48 and a peripheral sealing member 68
- Base 40
- Ball valve member 51

The embodiment illustrated in FIG. 7 also includes a preferred stainless steel sleeve 65 for the body of the decanter and a second, smaller stainless steel sleeve 66 for the upper portion of the decanter. These are provided for aesthetics and to obscure the working components (moveable wall 43 and valve sleeve 47) from view.

FIG. 7 also illustrated two branding opportunities for the application of labels 67 to the exterior of the decanter.

The movable wall moves upwardly and downwardly without tilting as this may cause a loss of seal between the movable wall and the main body portion which may allow the liquid to seep or flow between the movable wall and the main body portion. It is preferred that the liquid at all times remain above the movable wall and that the movable wall remains sealed to the interior surface of the main body portion. Therefore, movement of the movable wall will in turn move the level of the liquid.

Figure 8:
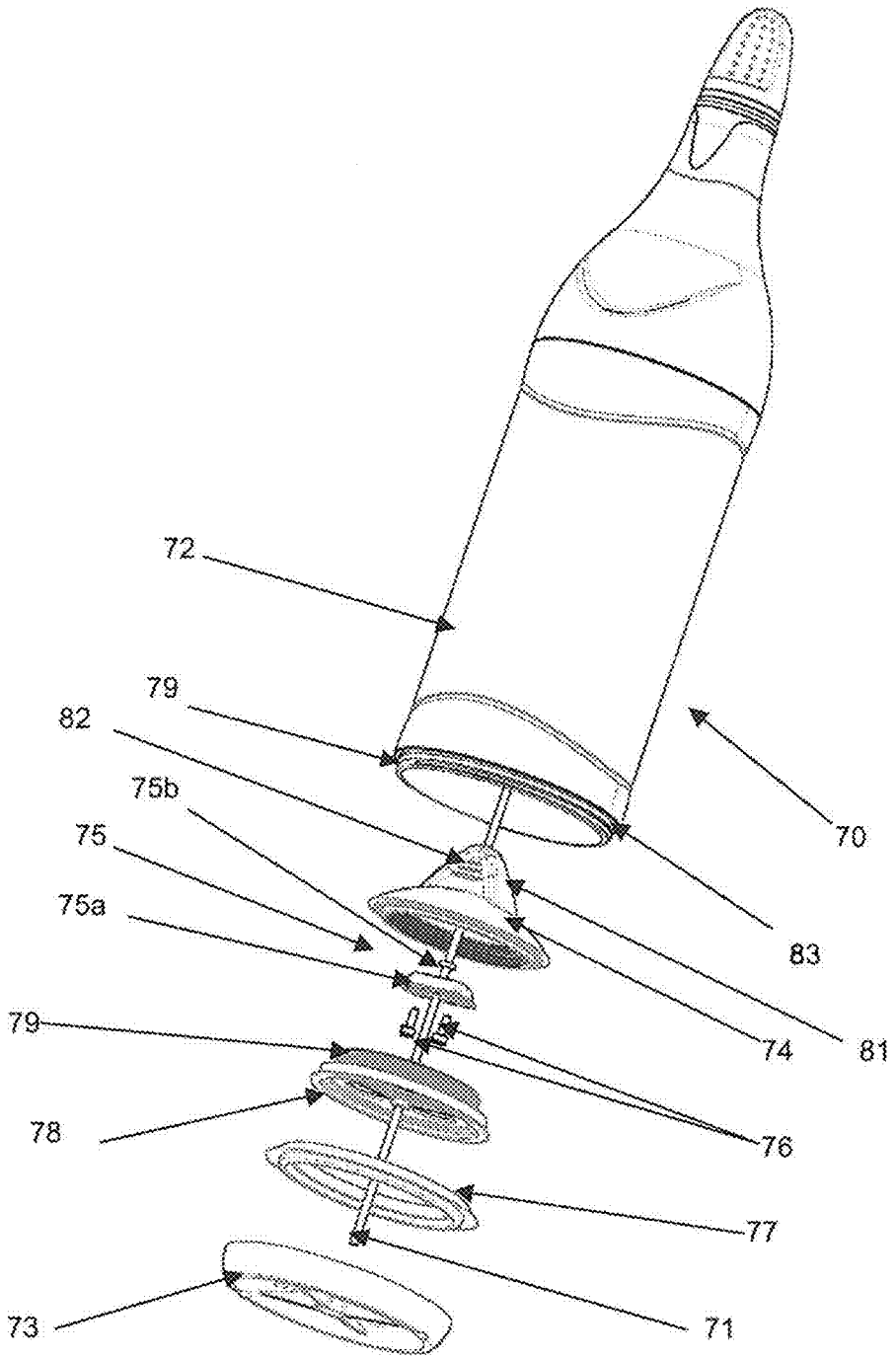
FIG. 8 is an exploded view of a further preferred embodiment of the decanter of the present invention.

In FIG. 8 there is illustrated an exploded view of a decanter 70 according to an alternative embodiment of the present invention. The upper region of the decanter 70 is essentially identical to that illustrated in FIG. 7. However, the lower region of the decanter 70 is different to that of the decanter illustrated in FIG. 7.

Specifically, the decanter 70 of FIG. 8 comprises a moveable wall guide portion 71 in the form of a rod that extends substantially vertically within the body 72 when the decanter 70 is in an upright position. The moveable wall guide portion 71 is connected at a lower end thereof to a base wall portion 73, the base wall portion 73 being screw-threadedly attached to the body 72 via a screw-threaded portion 83 of the body 72.

The moveable wall guide portion 71 extends upwardly from a central portion of the base wall portion 73 such that it passes through a central aperture (obscured) in the moveable wall 74. To ensure that liquid in the decanter 70 is unable to leak into the base wall portion 73 through the aperture in the moveable wall 74, the moveable wall 74 is provided with a seal portion 75 comprising a body portion 75*a* and an o-ring 75*b* that is located in abutment with the moveable wall guide portion 71 so as to form a seal therebetween. The body 75*a* of the seal portion 75 is attached to the moveable wall 74 via a pair of grub screws 76.

An airtight seal is also formed between the base wall portion 73 and the body 72 by providing a lower seal 77 that is positioned between the moveable wall 74 and a lower member 78 when the decanter 70 is assembled. The lower member 78 and the moveable wall 74 are provided with complimentary screw-threaded portions 79 to enable the moveable wall 74 and the lower member 78 to be engaged with one another, thereby "sandwiching" the lower seal 77 therebetween.

It may be seen in FIG. 8 that the moveable wall 74 is provided with an upwardly extending portion 81. The upwardly extending portion 81 includes a gripping portion 82 that is adapted to be gripped (for instance, by a user's fingers) in order to remove the moveable wall 74 from the decanter 70, such as for repair, replacement or cleaning.

Figure 9:
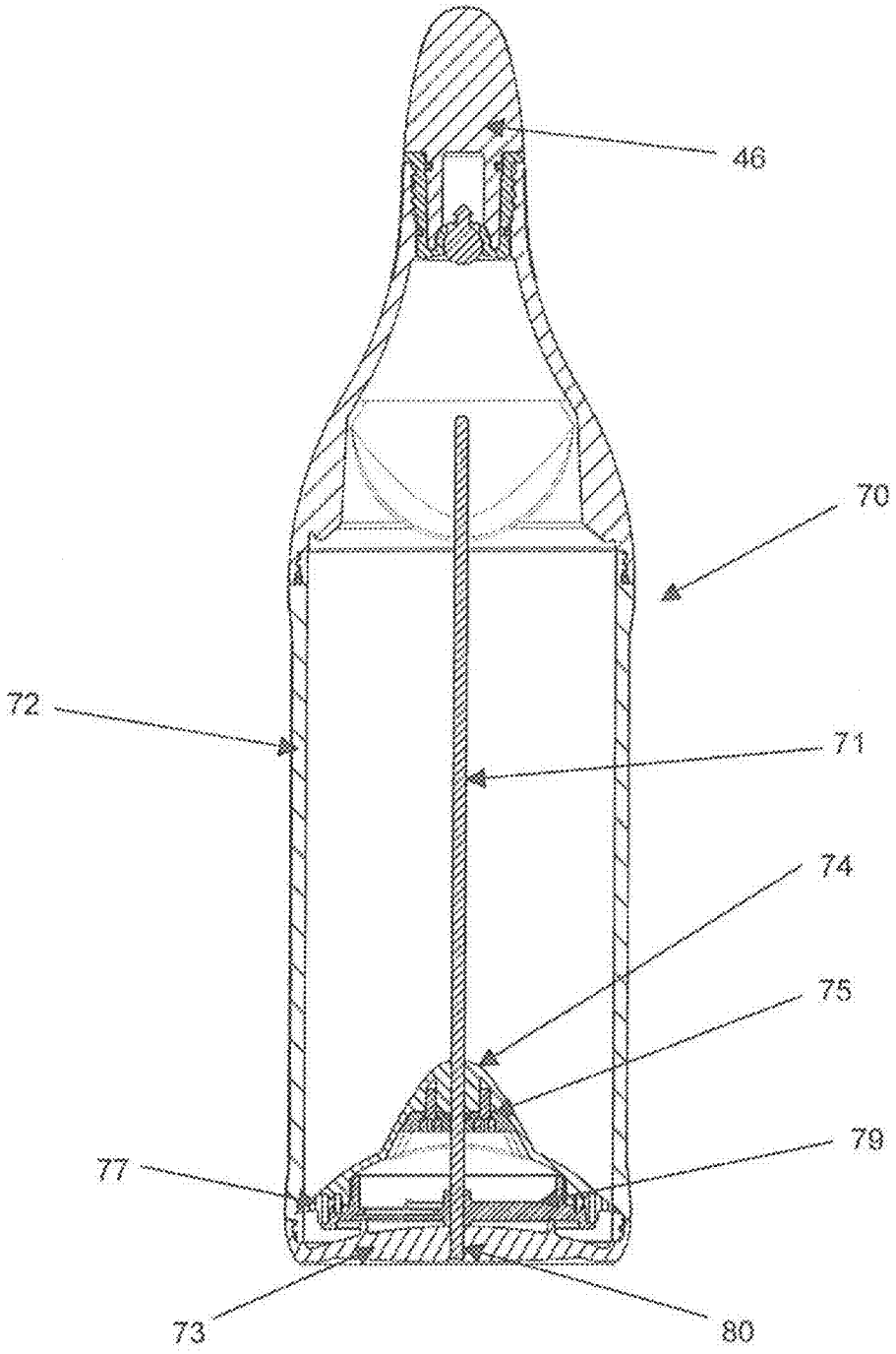
FIG. 9 is a cross-sectional view of the decanter of FIG. 8.

In FIG. 9, a cross-sectional view of the decanter 70 of FIG. 8 is illustrated. It may be seen in this Figure that the moveable wall guide portion 71 extends substantially vertically within the body 72. The lower end of the moveable wall guide portion 71 is received and retained in a receiving portion 80 in the base wall portion 73. The moveable wall guide portion extends upwardly through aligned apertures in the lower member 78, the sealing portion 75 and the moveable wall 74. Not only does this assist in maintaining the moveable wall guide portion 71 in a substantially vertical orientation, but it also assists in providing a seal that prevents the flow of liquid from the body 72 of the decanter 70 through the apertures towards the base wall portion 73.

In FIG. 9 it may be seen that the lower seal 77 is sandwiched between the lower member 78 and the moveable wall 74, thereby providing an airtight seal against the inner wall of the body 72. This airtight seal allows a vacuum to be applied to the decanter 70 that will result in the movement of the moveable wall 74 upwardly in the decanter 70 so as to reduce the volume of the decanter 70.

The upper end of the moveable wall guide portion 71 terminates below the cap 46 of the decanter 70 but above the upper limit of movement of the moveable wall 74.

Figure 10:
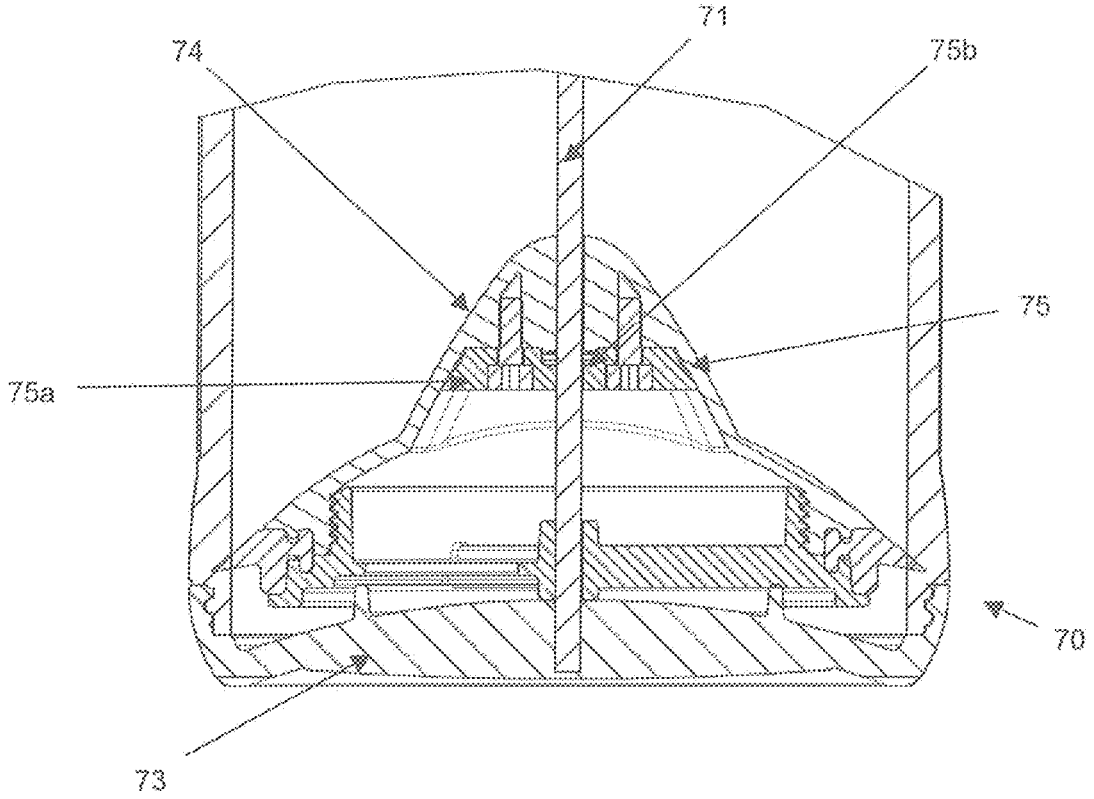
FIG. 10 is a detailed cross-sectional view of the decanter of FIGS. 8 and 9.

In FIG. 10, a detailed view of the lower portion of the decanter 70 of FIGS. 8 and 9 is illustrated. In this Figure it may be more clearly seen that the seal portion 75 comprises a body portion 75*a* and an o-ring 75*b*. A seal may be formed between the o-ring 75*b* and the moveable wall guide portion 71, the body portion 75*a* and the moveable wall guide portion 71, or a combination thereof.

It is envisaged that, in use (i.e. when a vacuum is applied to the decanter) the moveable wall 74 will move upwardly. The seal portion 75 will be maintained in sealing abutment with the moveable wall guide portion 71 at all times during movement of the moveable wall 74, thereby preventing fluid from escaping from the body 72 of the decanter 70 along the moveable wall guide portion 71 towards the base wall portion 73.

In the present specification and claims (if any), the word "comprising" and its derivatives, including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

What is claimed is:

1. A resealable decanter associated with a gas evacuation system, the decanter comprising:

a body with an upper opening adapted to be closed with a removable sealing closure, the body including a main body portion and an upper body portion removably attachable to the main body portion, a movable wall having an aperture located within the body, the moveable wall moveable at least upwardly within the body through application of a vacuum thereto, and a moveable wall guide portion that passes through the aperture in the moveable wall, the moveable wall guide extending beyond an upper opening of the main body portion, the sealing closure including a valve assembly located adjacent the upper opening allowing the vacuum applied to move the moveable wall thus moving the liquid within the decanter to evacuate gas from the decanter whilst preventing loss of liquid from the decanter as the vacuum is applied whereby the liquid contents are removable from the decanter by pouring from the decanter.

2. A resealable decanter associated with a gas evacuation system as claimed in claim 1 wherein the main body portion is a substantially hollow body and the removable upper body portion has a shoulder dimensioned to attach to the main body portion and a relatively smaller upper opening for pouring liquid from the decanter.

3. A resealable decanter associated with a gas evacuation system as claimed in claim 2 wherein at least one sealing member is provided between the main body portion and upper body portion to form a storage volume when the decanter is assembled.

4. A resealable decanter associated with a gas evacuation system as claimed in claim 3 wherein the movable wall is provided inside the body forming a base of the storage volume in the decanter into which a liquid is placed.

5. A resealable decanter associated with a gas evacuation system as claimed in claim 1 wherein the movable wall and an inner surface of the body are located relative to one another to maintain the movable wall in sealing engagement with the inner surface of the body during movement.

6. A resealable decanter associated with a gas evacuation system as claimed in claim 1 wherein the moveable wall is provided with an upwardly extending portion in order to minimise head space in the upper body portion of the decanter.

7. A resealable decanter according to claim 6 wherein the upwardly extending portion of the moveable wall includes a gripping portion for removing the moveable wall from the decanter.

8. A resealable decanter associated with a gas evacuation system as claimed in claim 1 wherein the sealing closure further includes a cap, the cap and valve assembly provided as separate but engageable with each other and the upper opening of the decanter.

9. A resealable decanter associated with a gas evacuation system as claimed in claim 8 wherein corresponding portions are provided on the cap and the valve assembly to allow engagement of the cap and valve assembly for movement together and disengagement for movement relative to one another wherein engagement permits removal of the valve assembly and cap for pouring of liquid contents via the upper opening and disengagement permits removal of the cap alone for application of a vacuum to the valve assembly.

10. A resealable decanter associated with a gas evacuation system as claimed in claim 8 wherein the valve assembly includes a sleeve portion adapted to be received at least partially into the upper opening of the decanter and be securable therein.

11. A resealable decanter associated with a gas evacuation system as claimed in claim 1 wherein a valve member functions to prevent liquid flow but allow gas flow and not seal under the imposition of a vacuum.

12. A resealable decanter associated with a gas evacuation system as claimed in claim 11 wherein the valve member functions as a float valve to prevent liquid flow.

13. A resealable decanter associated with a gas evacuation system according to claim 1 wherein the moveable wall guide portion comprises an elongate member extending substantially vertically within the body.

14. A resealable decanter associated with a gas evacuation system according to claim 1 wherein a lower end of the moveable wall guide portion is received in and retained by a receiving portion in a base wall of the decanter.

15. A resealable decanter associated with a gas evacuation system according to claim 1 wherein the moveable wall is associated with a seal portion that forms a seal with the moveable wall guide portion.

16. A resealable decanter associated with a gas evacuation system according to claim 1 wherein the moveable wall guide portion remains stationary relative to the body during movement of the moveable wall.

17. A resealable decanter associated with a gas evacuation system, the decanter comprising:

a body including:

a main body portion, and an upper body portion removably attachable to the main body portion, the upper body portion having an upper opening adapted to be closed with a removable sealing closure, the removable sealing closure including:

a valve assembly removably attachable relative to the upper opening, and a cap removably attachable to the valve assembly, a movable wall having an aperture located within the body, the moveable wall moveable at least upwardly within the body through application of a vacuum thereto via use of a removable vacuum device, and a moveable wall guide portion that passes through the aperture in the moveable wall, the moveable wall guide extending beyond an upper opening of the main body portion, wherein the valve assembly is located adjacent the upper opening of the upper body portion allowing the vacuum applied to move the moveable wall thus moving the liquid within the decanter to evacuate gas from the decanter whilst preventing loss of liquid from the decanter as the vacuum is applied whereby the liquid contents are removable from the decanter by pouring from the decanter, and wherein the cap and valve assembly are located relative to one another for allowing engagement of the cap with the valve assembly for movement permitting removal of the valve assembly and cap together for pouring of liquid contents via the upper opening and for disengagement of the cap from the valve assembly allowing independent movement of the cap and valve assembly permitting removal of the cap from the valve assembly for application of the vacuum to the valve assembly.

* * * * *